United States Patent [19]

Oling

[11] Patent Number: 4,580,660

[45] Date of Patent: Apr. 8, 1986

[54] LADDER ATTACHMENT

[76] Inventor: Morris Oling, 62 Niagara Rd., Kitchener, Ontario, Canada, N2B 1T2

[21] Appl. No.: 567,821

[22] Filed: Jan. 3, 1984

[51] Int. Cl.[4] ..... E06C 7/48

[52] U.S. Cl. ..... 182/107; 182/214; 248/210

[58] Field of Search ..... 182/214, 206, 107, 108, 182/111; 248/210

[56] References Cited

U.S. PATENT DOCUMENTS

| | | | |
|---|---|---|---|
| 783,259 | 2/1905 | Friends | 182/107 |
| 799,782 | 9/1905 | Ellinger | 182/214 |
| 1,800,792 | 4/1931 | Hansen | 182/214 |
| 2,680,554 | 6/1954 | Dakin | 182/214 |
| 2,710,129 | 6/1955 | Telech | 182/214 |
| 2,755,010 | 7/1956 | Ebbo | 182/214 |
| 2,856,112 | 10/1958 | Broderick | 182/206 |
| 2,903,086 | 9/1959 | Chubbs | 182/214 |
| 3,169,503 | 2/1965 | Lane | 182/214 |
| 3,708,080 | 1/1973 | Schlei | 182/214 |
| 3,910,378 | 10/1975 | Nyman | 182/214 |

FOREIGN PATENT DOCUMENTS

| | | | |
|---|---|---|---|
| 624292 | 7/1961 | Canada | 182/206 |
| 629851 | 9/1949 | United Kingdom | 182/214 |
| 973430 | 10/1964 | United Kingdom | 182/214 |

*Primary Examiner*—Reinaldo P. Machado

*Attorney, Agent, or Firm*—Rogers, Bereskin & Parr

[57] ABSTRACT

A stabilizing attachment for a ladder intended to make the ladder safer to use. The attachment includes a fixture capable of being secured at a selected position along the length of the ladder and support means comprising a cross member extending parallel to the rungs of the ladder and a pair of parallel struts coupling the cross member to the fixture. The support means can be arranged in either of two positions; in one position, the struts extend at right angles to the uprights of the ladder while in the other the struts extend parallel to the uprights. In either case, the cross member makes line contact with the structure against which the ladder is placed and the cross member may be provided with a friction-engendering surface to inhibit slipping of the cross member on the structure.

9 Claims, 6 Drawing Figures

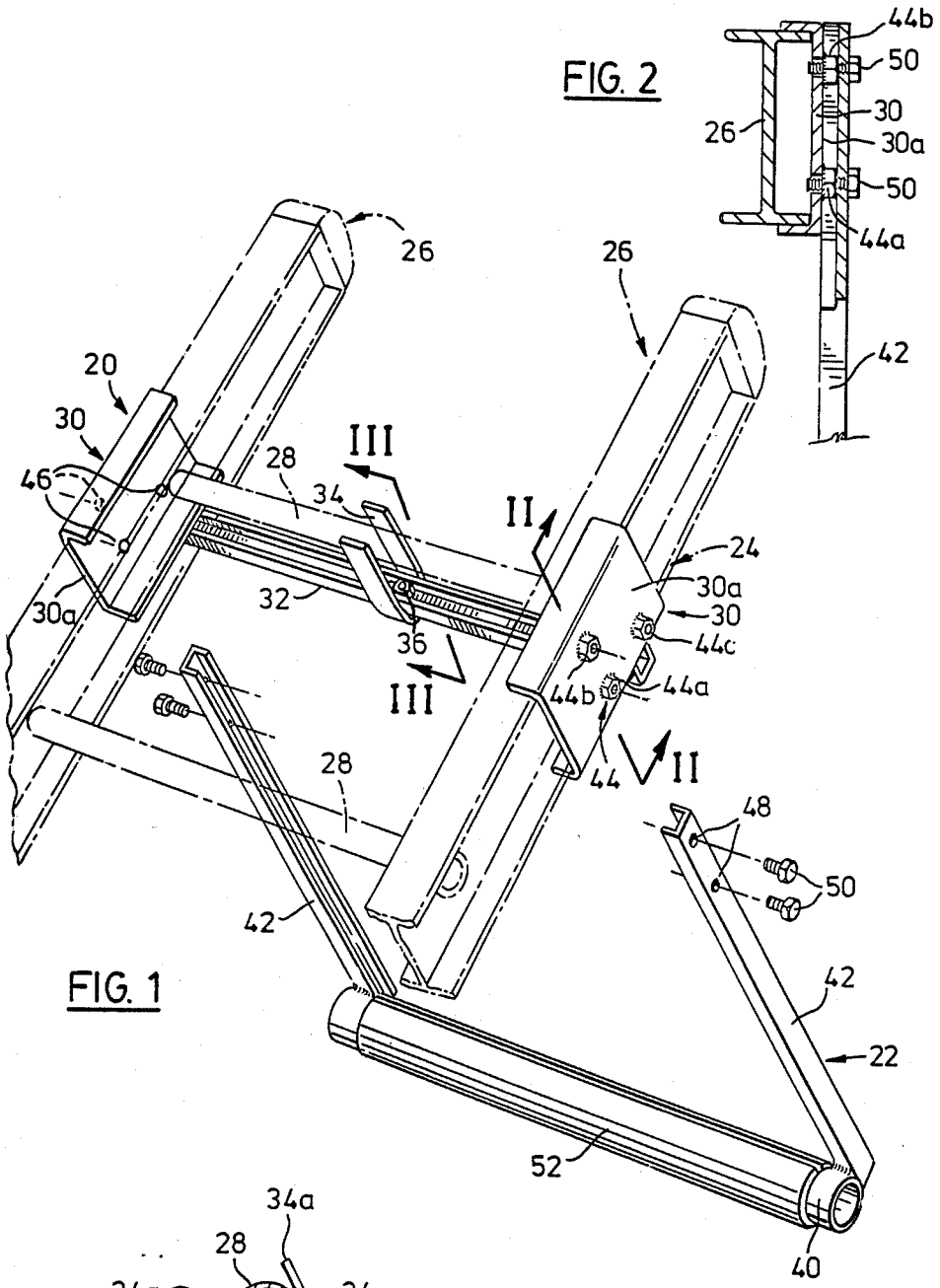
FIG. 1
FIG. 2
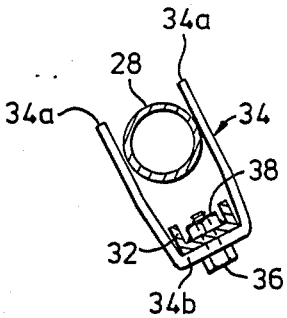
FIG. 3

LADDER ATTACHMENT

This invention is concerned with a stabilizing attachment for a ladder, intended to make the ladder safer to use.

An unrestrained ladder placed against a building or other structure is quite vunerable to tipping laterally. Even where a ladder is placed on a firm footing, a person working high on the ladder can quite easily cause it to overbalance, for example, by leaning too far to one side. Obviously, the problem is exacerbated where the lower end of the ladder is not on a firm footing (e.g. on a muddy construction site) or where the upper end of the ladder is not firmly located against the building or other structure. Examples of this type of situation are where the ladder is being used by a person to go up onto a roof to repair the roof and/or for painting the eavestroughs of a house. The ladder cannot normally be placed directly against the eavestrough because of the risk of damage to the eavestrough, the possibility of the ladder sliding and its vulnerability to tipping. For installing eavestroughing, the ladder must be balanced in another location just below the eavestrough. Not only does this mean that the top end of the ladder is not securely located but the person using the ladder may not be able to conveniently reach the location to be painted or repaired or at which the eavestroughing is to be installed, with the consequent risk that he may overreach and cause the ladder to tip.

In the construction industry, it is recognized as good practice to tie off a ladder to, say, scaffolding, or otherwise restrain the top ends of the ladder uprights. However, in practice, these safeguards are often bypassed because they take time to implement.

An object of the present invention is to provide a stabilizing attachment for a ladder aimed at alleviating these problems.

In one aspect, the invention provides a ladder attachment comprising a fixture capable of being secured at a selected position along the length of the ladder and comprising a pair of inwardly facing channel members adapted to embrace respective uprights of the ladder at outer sides thereof, a brace connecting said members, and means engageable with an appropriate rung of the ladder and adapted to locate the fixture at a said selected position. The attachment also includes support means comprising a cross member of a length corresponding at least to the width of the ladder and intended to lie in line contact with the structure against which the ladder is placed while extending generally parallel to the rungs of the ladder. A pair of spaced parallel struts are coupled to and extend generally normally from the cross member at positions spaced therealong to correspond generally with the spacing of the channel members. Means is provided to couple the support means to the fixture in either of a first position in which the struts extend generally normally with respect to the ladder uprights and the cross member is spaced outwardly of the rungs, and a second position in which the struts are generally parallel to the uprights and the cross member is generally in line with the rungs.

In either position of the support means, the cross member provides a line contact surface between the ladder and the structure against which the ladder is placed, having a much greater area than the normal two point contact areas provided between the top ends of the ladder uprights and the structure. The cross member may be provided with a friction-engendering surface, preferably by means of a resilient coating of rubber or like material which will deform under the weight of a person on the ladder to provide an even greater contact area.

In any event, in the first position of the support means, the struts between the cross member and the fixture space the ladder outwardly from the structure. This position is particularly convenient and safe where the ladder is being used, say, for painting the eavestroughs of a house, for roof repair, or by a person going up onto the roof carrying, say, shingles. The cross member can then be placed against the roof above the eavestrough so that the ladder will lie over but clear of the eavestrough while at the same time the cross member will be applied against the roof under the weight of the person on the ladder, which will inhibit tipping. The second position of the support means may be more useful where the ladder is required to be closer to the structure, e.g. for cleaning, painting, or repair purposes.

According to other aspects of the invention, the attachment may comprise a fixture of the form defined above and support means permanently affixed to the fixture in either of the said first and second positions. In this event, the fixture would be less versatile than one in which two positions are provided for the support means but this form of attachment may be adequate in some circumstances.

In order that the invention may be more clearly understood, reference will now be made to the accompanying drawings which illustrate a preferred embodiment thereof by way of example, and in which:

FIG. 1 is a partly exploded perspective view of a ladder attachment located on the upper end portion of a ladder shown in ghost outline;

FIGS. 2 and 3 are sectional views on lines II—II and III—III respectively of FIG. 1;

Figure 4:
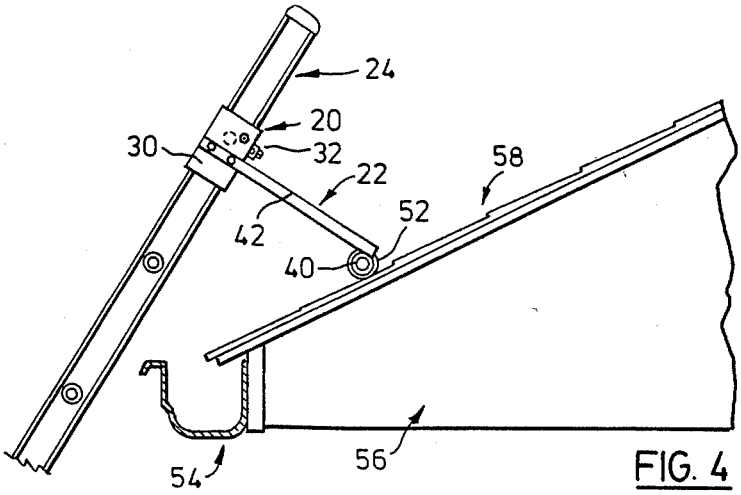
FIG. 4 is a partial side elevational view showing the attachment in use on a ladder with the support means of the attachment in its first position; and, FIGS. 5 and 6 are views similar to FIG. 4 showing two different situations in which the attachment can be used with the support means in their second position.

Referring first to FIG. 1, the attachment provided by the invention comprises a fixture generally denoted 20 and support means denoted 22 shown partly exploded away from the fixture. The fixture itself is shown in a typical position it would occupy on the upper end portion of a ladder indicated in ghost outline at 24. The ladder is shown as a conventional aluminum ladder comprising a pair of uprights 26 of I-shape in cross-section and cylindrical rungs, too of which are shown at 28 extending between the uprights. This particular type of ladder is shown for illumination only; the attachment may of course be used with other types.

Fixture 20 includes a pair of inwardly facing U-shaped channel members 30 which embrace the respective uprights 26 of the ladder at outer sides thereof, and a brace 32 connecting the channel members. The brace is provided with a U-shaped element 34 arranged to engage an appropriate rung of the ladder for locating the fixture at a selected position along the length of the ladder as will be more particularly described below.

In this embodiment, the components of the fixture are made of steel and brace 32 is welded at its ends to the channel members 30. Brace 32 is itself a U-shaped channel as shown although this is not of course essential to the invention. The channel members 30 are shaped to closely embrace the ladder uprights 26 so that the fixture will be securely held on the ladder; at the same time, there should be some clearance between the channel members and the uprights so that the fixture can be slid along the ladder for adjustment purposes when element 34 has been removed. Similarly, brace 32 is of a length selected to correspond fairly closely with the overall width of the ladder and the channel members are welded to the brace at positions spaced along the brace to provide for a snug fit of the channel members on the ladder while allowing the required sliding movement. FIG. 2 illustrates this relatively snug fit by reference to one of the two channel members 30.

FIG. 3 shows the element 34 of fixture 20 in engagement with one of the rungs 28 of the ladder (shown in full lines in this view). Element 34 has limbs 34*a* spaced to embrace the rung 28 as shown, and a base 34*b* dimensioned to fit around the brace 32 and connected thereto by a bolt 36 which extends through aligned openings in element 34 and brace 32 and which is fitted with a nut 38 welded inside the channel of brace 32.

With element 34 positioned as shown in FIGS. 1 and 3, the fixture 20 is located on the ladder and in effect provides a base for the support means 22. However, the position of the fixture can be readily changed by removing bolt 36 and element 34 so that the channel members 30 can slide to a different position along the length of the ladder. Element 34 can then be bolted back onto brace 32 at the relevant position, engaging a different rung. In practice, however, it anticipated that the fixture will probably remain permanently attached to the ladder at the position of an appropriate rung and since the support means 22 are removable from the fixture this will not affect use of the ladder without the attachment.

Element 34 in fact merely serves to prevent the attachment sliding down the ladder; the primary force holding the attachment to the ladder is generated by the weight of a person on the ladder, causing the channel member 30 to tend to twist about an axis parallel to the ladder rungs and frictionally grip onto the uprights.

Support means 22 comprises a cross member 40 of a length corresponding generally to the width of the ladder, and a pair of spaced parallel struts 42 coupled to and extending generally normally from the cross member 40 in positions spaced therealong to correspond generally with the spacing of the channel members 30. In the illustrated embodiment, the struts 42 are channel members similar to brace 32 and are arranged with their channels facing one another; again, this shape is not essential. The spacing between the struts 42 is in fact approximately equal to the space between the outer surfaces 30*a* of the channel members 30 so that the support means 22 can be positioned with the struts 42 embracing the channel members 30 and in contact with the outer surfaces 30*a* of both channel members.

Welded to each of those channel member outer surfaces 30*a* are three captive nuts generally indicated at 44. The nuts are arranged in a triangular configuration with two of the nuts, denoted 44*a* and 44*b* aligned transversely of the channel member 30 while the third nut 44*c* is aligned with nut 44*a* longitudinally of the channel member. Also, the nuts are positioned so that the centers of the aligned pairs of nuts are equally spaced; that is, the spacing between the centers of nuts 44*a* and 44*b* is equal to the spacing between the centers of nut 44*a* and nut 44*c*. Clearance holes are drilled in the channel members below the nuts and the holes in the channel member which is shown at the left in FIG. 1 are visible at 46. The configuration of nuts and clearance holes will of course be the same for both channel members.

The struts 42 are dimensioned so that their channels will embrace the nuts 44 and each strut is provided in the base of its channel with a pair of holes 48 spaced to correspond with the spacing between the respective pairs of nuts 44 on the channel members. Bolts to be received in those holes 48 are indicated at 50. It will of course be appreciated that this configuration of nuts and holes 48 in the struts 42 allows the support means to be bolted to the channels members 30 in either of two positions spaced at 90° from one another (although a 90° angular spacing is not essential to the invention). Thus, if the support means 22 is moved towards the channel members 30 from the position in which it is shown in FIG. 1, the struts 42 will embrace the nuts 44*a* and 44*b* and the support means can be bolted to the channel members 30 by the nuts 50 in a first position in which the struts extend generally normally with respect to the ladder uprights 26. Alternatively, the struts 42 can be positioned in alignment with the pair of nuts denoted 44*a* and 44*c* and bolted to the channel member using those nuts, in which case the support means adopts a second position in which the struts are generally parallel to the ladder uprights and the cross member 40 is in line with the ladder rings. The support means are shown in the first position in FIG. 4 and in the second position in FIGS. 5 and 6. It will be seen from all of these views (and from FIG. 1) that the struts 42 extend generally tangentially from the cross member. The cross member is a steel tube and the struts are steel channels and they are welded together in this configuration. This means that the cross member in effect hangs down below the struts which is particular importance in a situation in which the cross member can be so to speak "hooked over" a support generally as shown in FIG. 6; this makes for further improved stability of the ladder.

Referring briefly back to FIG. 1, it will be seen that the cross member 40 is fitted with an external sleeve 52 which extends between the struts 42. Sleeve 52 is made of a rubber or other resilient material and is secured on the cross member 49, e.g. by adhesive or rivets. Typically, the rubber material will be selected so as to be compressible under the weight of a person on the ladder to increase the area of surface contact between the support means 22 and a structure against which the ladder is placed. The surface characteristics of the sleeve 52 also provide for improved frictional grip.

In FIG. 4, the attachment is shown in place on a ladder 24 positioned as for installing, painting or repairing an eavestrough 54 on a house 56. The fixture 20 is located on the ladder as shown in FIG. 1 and the support means 22 are disposed in the first position referred to above in which the struts 42 extend generally normally with respect to the ladder uprights. The rubber sleeve 52 on cross member 40 is shown bearing down on the roof 58 of the house and it will be seen that the ladder is supported clear of the eavestrough and at the same time is stabilized by virtue of the line contact between the cross member and the roof 58. Also, it is believed that the stress in the ladder uprights will be reduced as compared with a similarly loaded ladder without the attachment due to the fact that the ladder is partly in effect "hooked" onto the roof, and that this in turn will allow the same ladder to carry greater loads.

Figure 5:
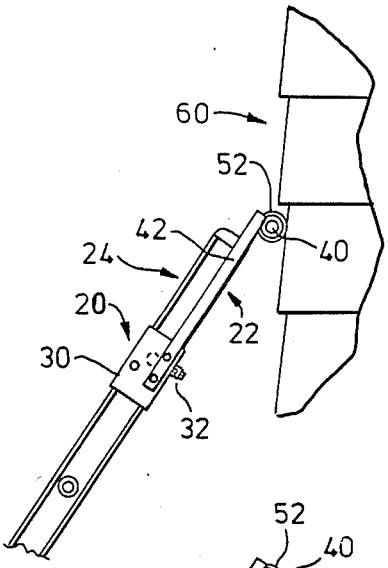
Figure 6:
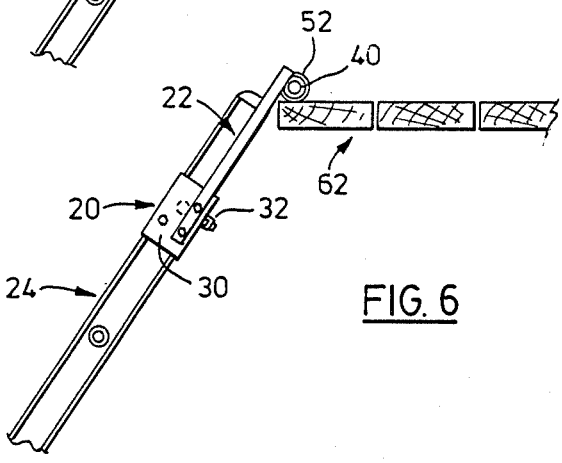

FIGS. 5 and 6 show the fixture 20 at the same position on the ladder but with the support means 22 in its said second position in which the struts 42 are generally parallel to the uprights. In FIG. 5, the cross member 40 is shown making line contact with siding 60 on a house and it will be understood that the line engagement between the cross member and siding will inhibit tipping of the ladder and avoid damage to the siding. In FIG. 6, the attachment is shown with the cross member 40 "hooked" over the edge of a scaffolding platform 62, say, on a construction size. This obviously provides for even more secure stabilization because the ladder 24 is positively prevented from pivoting laterally about its lower end because of the engagement between the cross member 40 and the platform 62.

It will of course be understood that the preceding description relates to a particular preferred embodiment of the invention only and that many modifications are possible within the broad scope of the invention. For example, the attachment could be designed to allow the support means 22 to occupy positions other than the two positions referred to above, e.g. two positions spaced by other than 90° or three or more different positions. Also, as indicated previously, the attachment could be constructed with the support means 22 permanently attached to the fixture 20 and while this would limit the range of application of the attachment, in some situations, this might be acceptable.

The provision of a rubber sleeve on the cross member 40 is believed to represent a preferred method of providing a friction engendering surface on the cross member but is not essential. Another alternative would be to knurl or otherwise roughen the surface of the cross member itself. In another embodiment, the cross member could be of a length greater than the width of the ladder for further improved stability. It should also be understood that the coupling arrangements between the support means 22 and the fixture 20 can vary; for example, a lockable keyed slide or other coupling arrangement could be employed. Also, the fixture could be (located on) a rung of the ladder other than in the manner illustrated, for example, by a latch on one of the channel members engaging a rung. The brace 32 between the channel members and the cross member 40 can be made adjustable to fit different widths of ladder although this may be undesirable if it results in a reduction in the strength of the attachment. Obviously, the particular forms of components and materials described above may vary.

I claim:

1. An attachment for a ladder, comprising:

a fixture capable of being secured at a selected position along the length of the ladder and comprising a pair of inwardly facing channel members adapted to embrace respective uprights of the ladder at outer sides thereof, a brace connecting said members, and means engageable with an appropriate rung of the ladder and adapted to locate the fixture at a said selected position;

support means comprising a cross member of a length corresponding at least to the width of the ladder and intended to lie in line contact with a structure against which the ladder is placed and extend generally parallel to the rungs of the ladder, and a pair of spaced parallel struts coupled to and extending generally normally from said cross member in positions spaced therealong to corresponding generally with the spacing of said channel members; and, coupling means adapted to removably secure the said support means to the fixture in either of a first fixed position in which the struts extend generally normally with respect to the ladder uprights and the cross member is spaced outwardly of the rungs, and a second fixed position in which the struts are generally parallel to the uprights and the cross member is generally in line with the rungs said coupling means permitting adjustment of the support means between its said first and second position only after removal of the support means from the fixture.

2. An attachment as claimed in claim 1, wherein said cross member is provided with a friction-engendering surface for engagement with a said structure against which the ladder is placed.

3. An attachment as claimed in claim 2, wherein said friction-engendering is provided by a resilient sleeve secured to said cross member.

4. An attachment as claimed in claim 1, wherein said struts are arranged to extend generally tangentially with respect to said cross member with the cross member disposed below the struts when the attachment is in use.

5. An attachment as claimed in claim 1, wherein said coupling means comprise captive nuts on outer surfaces of said channel members and bolts engageable with said nuts through openings in said struts, said nuts being arranged in a configuration permitting coupling of the struts to said cross members in either of said first and second positions.

6. An attachment as claimed in claim 5, wherein said struts are U-shaped channels and are arranged with their channels facing inwardly and adapted to engage over said captive nuts when the support means is fitted to the fixture.

7. An attachment as claimed in claim 1, wherein said means engageable with an appropriate rung of the ladder comprises a generally U-shaped locating element removably secured to said brace and adapted to embrace a said ladder rung.

8. An attachment as claimed in claim 7, wherein said brace is disposed within said U-shaped element and said brace and element are removably secured together by a nut and bolt.

9. An attachment as claimed in claim 1 wherein said cross member presents a generally cylindrical surface intended to lie in line contact with a said structure against which the ladder is placed.

* * * * *